United States Patent [19]

Gustafsson et al.

[11] 4,059,182

[45] Nov. 22, 1977

[54] MOSAIC PRINTER

[75] Inventors: Lars Ake Olof Gustafsson; Carl-Otto Ulin, both of Jarfalla, Sweden

[73] Assignee: U.S. Philips Corporation, New York, N.Y.

[21] Appl. No.: 703,177

[22] Filed: July 7, 1976

Related U.S. Application Data

[63] Continuation of Ser. No. 535,134, Dec. 20, 1974, abandoned.

[30] Foreign Application Priority Data

Dec. 20, 1973 Sweden ..... 73172017

[51] Int. Cl.[2] ..... B41J 3/04

[52] U.S. Cl. ..... 197/1 R; 101/93.05

[58] Field of Search ..... 197/1 R; 101/93.04, 101/93.05

[56] References Cited

U.S. PATENT DOCUMENTS

| | | | |
|---|---|---|---|
| 3,209,681 | 10/1965 | Sanborn | 197/1 R X |
| 3,330,208 | 7/1967 | Eckel | 101/93.04 |
| 3,598,218 | 8/1971 | Gildvich et al. | 197/1 R |
| 3,627,096 | 12/1971 | Finnegan | 197/1 R |

*Primary Examiner*—Ralph T. Rader

*Attorney, Agent, or Firm*—Frank R. Trifari; Robert S. Smith

[57] ABSTRACT

A mosaic printer comprising a printing head with relative movability along a printing line on a printing sheet to be printed. The head supports a number of wire ends arranged along a substantially rectilinear line extending perpendicular to the printing line and each wire end upon excitation producing a printing mark on the printing sheet, desired signs being formed by selective activation of the said wire ends during relative motion of the printing head. According to the present invention at least the front portion of the printing head, which determines the orientation of the said substantially rectilinear line, is rotatable about an axis, which is substantially perpendicular to the printing sheet, whereby signs having different inclinations can be formed by rotating the front part of the printing head.

4 Claims, 5 Drawing Figures

MOSAIC PRINTER

Figure 1:
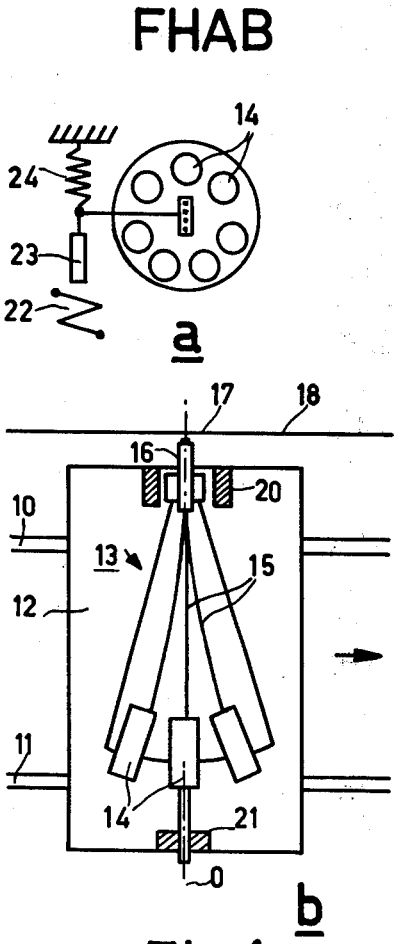

This is a continuation, of application Ser. No. 535,134, filed Dec. 20, 1974 now abandoned.

The invention relates to a mosaic printer of the kind which has a printing head with relative movability along the line on a printing sheet to be printed, which printer head is provided with a number of printing elements which elements upon excitation each produce a printing mark and which elements at the output surface from the printing head in the vicinity of the printing sheet are arranged substantially along a rectilinear line transversally of the printing line, printing being effected by selectively activating the said printing elements under motion of the printing head along the line to be printed for producing the desired signs.

Such printers are usually used as output means in small size data equipments, terminal systems, as bank terminals and the like. It has also been proposed to use printers of this kind in telex apparatuses. In all these applications it can be advantageous to be able to print the text in different manners for enabling a viewer to discriminate between different categories of printed information. Thus, it can be desirable in bank terminals to be able to discriminate between different types of bank transactions in a balance. In telex apparatuses it is generally desirable to be able to judge, if the text relates to a transmitted or a received message. Hitherto this has been made by use of different colours on the printing tape at transmission and reception, which, however, does not give any observable difference of the text on possible copies.

By the present invention a possibility is achieved to make an adjustment of the printer in a very simple manner so that the printed text can be given different characters, more closely different inclination of the signs.

The characteristic for the invention consists in that at least that portion of the printing head, which is closest to the printing sheet and which determines the orientation of the said substantially rectilinear line of printing elements, is rotatable about an axis, which is substantially perpendicular to the printing sheet, and actuated by a setting mechanism to assume either of at least two positions, in which the said line makes different angles with the relative motion direction of the printing head for producing signs with different inclination.

Suitably the said line formed by the printing elements can in one setting position be oriented perpendicular to the motion direction for producing signs without inclination, while in another setting position the said line is oblique in the one or the other direction for producing signs with forward or backward inclination. If desired, setting can be effected between all these three angular positions of the printing head or the front part of the same for producing signs with three different, easily observable inclinations.

The invention utilizes the property of a mosaic printer of this kind, that a sign is not printed simultaneously by an impact against the printing sheet but successively column by column under relative motion between the printing head and the printing sheet. Hereby the simple measure of inclining the head with the sign elements in different angles will result in that only those portions of the signs, which are normally vertical, will have different inclinations, which is desirable, while those parts of the signs, which are normally oriented in the direction of the printing line, will still have this orientation independently of the inclination of the head, as the inclination of these parts only depends upon the relative motion direction. No changed coding for actuation of the printing elements is required but these are controlled in exactly the same manner at printing of inclined signs as in case of printing of vertical signs. The term printing elements should be understood in its broadest sense. Printing elements could be formed by printing wires in impact printers, by electrodes in electrostatic printers and also by semiconductors elements like diodes in thermal printers.

The invention is illustrated by the attached schematic drawings, in which

Figure 2:
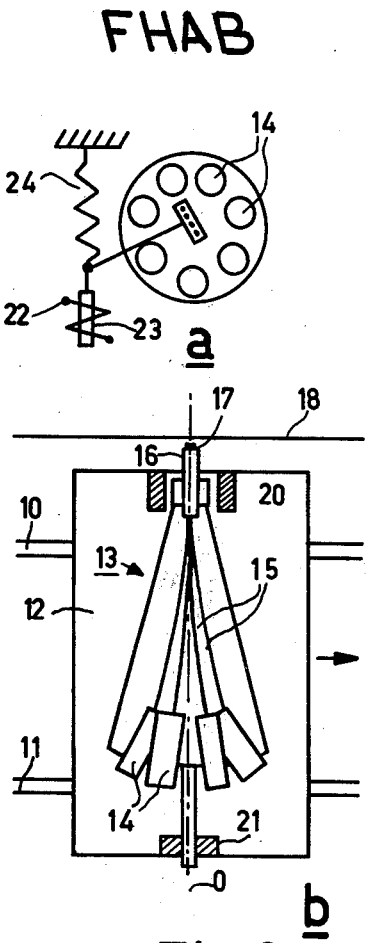
Figure 3:
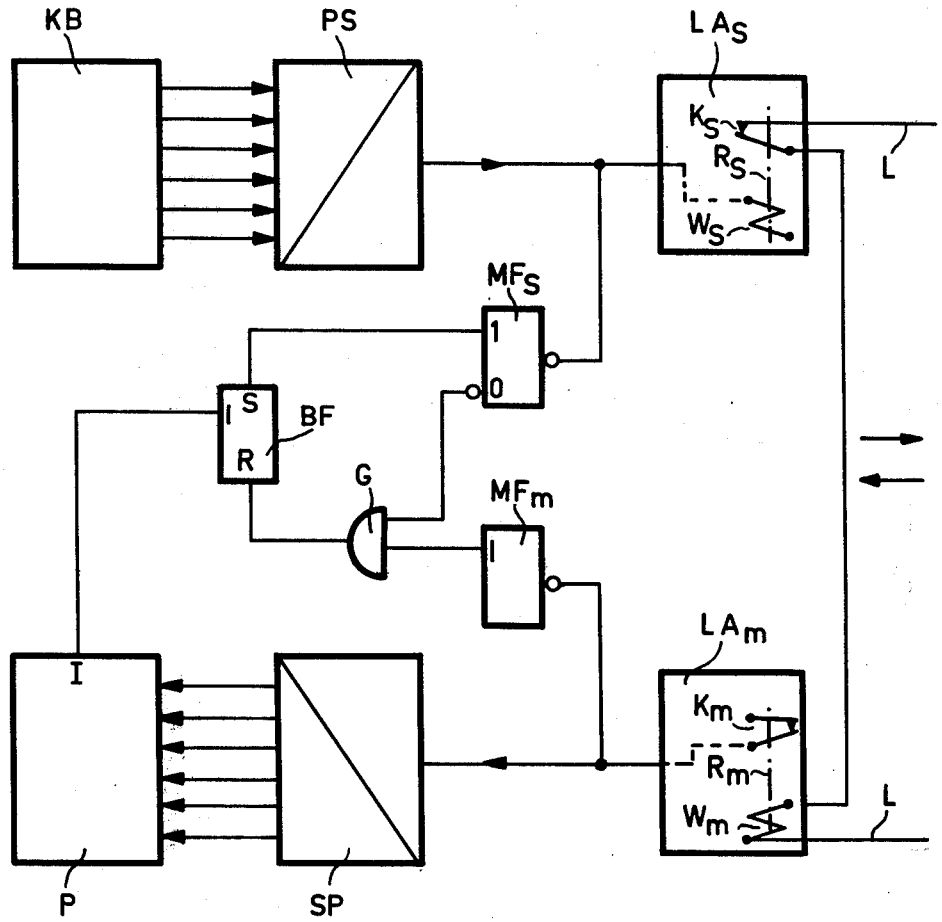

FIG. 1*a* shows a simplified end view of a printing head in one setting position in an embodiment of a mechanic printer chosen as an example and provided with a setting mechanism according to the invention, FIG. 1*b* shows a horizontal view of the printing head in the same setting position, FIGS. 2*a* and 2*b* show corresponding views of the printing head in the second position and FIG. 3 shows a block diagram for a telex apparatus, in which a printer as shown in FIGS. 1 and 2 is included, and furthermore a control circuit for automatic setting of the printer at the switching-over from transmission to reception and vice versa.

In FIGS. 1 and 2 reference numerals 10 and 11 designate two guidance bars, on which a carriage 12 is movable in the motion direction indicated by the arrow. The carriage supports a printing head 13, which in the shown example consists of seven wire magnets 14 and associated printing wires 15. At their free ends the wires are passing close to each other through a guide 16, which is shaped such that the said free ends 17 of the wires at the output of the guide are oriented in a rectilinear line transversally to the motion direction of the printing head. The carriage with the printing head is mounted such that in unactuated condition of the wire magnets the said free ends of the wires are situated at a small distance from a printing sheet 18. This sheet 18 can be a pressure sensitive paper or a common paper sheet with colour tape. Printing is effected in known manner by selective excitation of the wire magnets by short lasting drive pulses from a sign generator (not shown) during motion of the printing head along the printing sheet, so that the associated wires will momentaneously impinge against the printing sheet for producing printing dots, the excitation being such that the combination of the produced dots will form the desired signs.

According to the invention the printing head is rotatably mounted on the carriage by means of two bearings 20, 21 allowing rotation of the head about an axis 0, which is perpendicular to the printing sheet. The rotation is controlled by an electromagnet 22, which acts upon an armature 23 rigidly connected to the head, and a return tension spring 24. When the magnet 22 is unexcited the spring 24 maintains the head 13 in a rotational limit position, which is shown in the FIGS. 1*a* and 1*b*. In this position the said line of printing wire ends in the printing head makes a right angle with the motion direction. The excitation of the wire magnets from the sign generator then is for example such, that the produced signs will be vertical, as illustrated at the left in FIG. 1*a*.

When the magnet 22 is excited the head 13 will be rotated to the second rotational limit position, which is shown in the FIGS. 2*a* and 2*b*. In this position the said line of wire ends makes an angle with the motion direction, which deviates from 90°. More closely in the shown example the end of uppermost wire is situated more rearward as seen in the motion direction than the lower wire end. With exactly the same excitation of the wire magnets as in the preceding case now the signs will be inclined backwardly, as illustrated to the left in FIG. 2*a*. It is noted that only the vertical parts of the signs will change their inclination, while the horizontal parts of the signs will maintain their horizontal orientation, which is desirable for achieving easily readable signs.

If the head is also made rotatable in the other direction, as counted from the position as shown in FIGS. 1*a* and 1*b*, it will also be possible to produce forwardly inclined signs and if desired it is also possible to set the head in inclination angles of different magnitude in relation to the motion direction for producing signs with forward or backward inclinations of different size.

Instead of rotating the whole printing head as shown it is also possible to only rotate the front part of the same with the guide 16 for the printing wire ends.

FIG. 3 shows a simplified block diagram for a telex apparatus with a printer according to FIGS. 1 and 2 and a circuit for automatic setting of the printer between a condition at transmission, in which it prints signs with a certain inclination, and another condition at reception, in which it prints signs with another inclination.

The telex apparatus consists of key board KB, the output signal of which upon pressing down of a key is led in parallel form to a parallel/series converter PS, which converts the parallel code to a corresponding series code. This is transmitted via a line matching unit $LA_s$ through a two-wire line L. Incoming signal in series form on the same line L passes through a line matching unit $LA_m$ to a series/parallel converter SP, which converts the incoming series code to a parallel code. This is led to a printer P, in which the sign corresponding to the code is printed.

The line matching units $LA_s$ and $LA_m$ have for their purpose to convert the internal signal level to the signal level which is suitable for the line L and to produce galvanic separation between the apparatus and the line. The units $LA_s$ and $LA_m$, which in reality consist of logic circuit elements and optic coupling for producing galvanic separation, are in the drawing schematically shown as consisting of a transmitter relay $R_s$ and a receiver relay $R_m$, respectively. The contact $k_s$ of the transmitter relay is in rest position closed and connected to the line L in series with the winding $W_m$ of the receiver relay. As soon as signals appear on the line L these signals will pass via the closed transmitter contact $k_s$ to the winding $W_m$ of the receiver relay, which transmits the signals further to the printer P. At transmission the pulses to be transmitted are generated by the transmitter relay $R_s$. Except being sent out on the line L the pulses will also pass into the receiver relay, so that the signs corresponding to the transmitted code signals are printed in the printer of the own apparatus. The circuit arrangement is called half duplex or "telex"-coupling and involves that both transmission and reception is effected by means of one and the same two-wire line; however, not simultaneously.

The printer P is of described kind and can be switched between two different condition, in which it prints signs with different inclination. Decisive for the inclination of the signs printed in each moment is a control signal applied to an input terminal I. The control signal is obtained from a bistable flip-flop BF, which has a set input S and a reset input R. When the flip-flop is set a signal corresponding to logic 1 is led to the printer, while in reset condition a signal corresponding to logic 0 is led to the printer. The control signals for the flip-flop BF are obtained from two monostable flip-flops $MF_s$ and $MF_m$ having their trigger inputs connected to the connection line between the parallel/series converter PS and the line matching unit $LA_s$ in the transmitter and to the connection line between the matching unit $LA_m$ and the converter SP in the receiver, respectively. The flip-flop $MF_s$ and $MF_m$ are thus supplied with the pulse sequence in series form, which is transmitted, and the pulse sequence in series form, which via SP is fed to the printer, respectively. The flip-flops $MF_s$ and $MF_m$ are resettable and have such a run time, for example 150 ms, that they are not able to return to rest position at a normal pulse flow at transmission and reception respectively. Not until an interruption appears in this pulse flow, which exceeds the run time for the respective flip-flop, this flip-flop returns to its rest position. The flip-flop $MF_s$ connected to the transmitter has its non-inverted or so called 1-output connected directly to the set input S of the bistable flip-flop BF. The receiver flip-flop $MF_m$ has its 1-output connected to the reset input R of the bistable flip-flop BF via an AND-gate G, which at a second input receives the signal from the inverted or 0-output of the first monostable flip-flop $MF_s$.

The function is as follows.

In rest position the bistable flip-flop BF can assume either of its two stable conditions. In each of these conditions different signals are fed to the printer P, so that this printer is set for printing signs with the one or the other character. Now, if transmission of a message is initiated by pushing down keys on the key board KB a pulse train will appear from the converter PS. Each pulse in the pulse train will trigger the monostable flip-flop $MF_s$ so that this flip-flop will be maintained in its set position provided that the pulses appear with closer intervals than the run time for the flip-flop. In this condition the flip-flop $MF_s$ delivers set signal to the bistable flip-flop BF at its input S so that, independently of the position the flip-flop BF had initially, the said flip-flop will assume the so called set condition. The flip-flop BF delivers 1-signal to the printer P so that this printer is set for printing signs with a certain given inclination, associated to transmission. The transmitted pulse train also passes into the receiver so that signs corresponding to the transmitted pulse code are printed in the printer P. The monostable flip-flop $MF_m$ delivering signal to the reset input R of the bistable flip-flop is then also triggered so that it assumes set condition. This signal is, however, blocked by the AND-gate G, which at its second input receives 0-signal from the flip-flop $MF_s$, and the signal from $MF_m$ does not reach the input R.

If the transmission should cease both the monostable flip-flops $MF_s$ and $MF_m$ will return but the bistable flip-flop BF remains in its assumed position.

If instead a pulse sequence is received only the monostable flip-flop $MF_m$ will be triggered. As the second monostable flip-flop $MF_s$ associated with the transmitter is not set it will deliver 1-signal at its 0-output to the gate G. The gate G thus obtains 1-signal on both inputs and delivers 1-signal to the reset input R of the bistable flip-flop, so that this will be reset to rest position. The flip-flop BF then delivers 0-signal to the printer so that this will be set in the other position for printing of signs having another inclination, associated with reception. When the received pulse flow ceases the flip-flop $MF_m$ will return but the flip-flop BF will remain in its assumed position.

The bistable flip-flop BF can possibly be omitted, in which case also the gate G and the flip-flop $MF_m$ will be superfluous. The signal from the flip-flop $MF_s$ is then led directly to the control input of the printer P for setting the same in the condition, in which it prints signs with a character associated with transmission. For each interruption in the transmitted pulse flow the flip-flop $MF_s$ will return to its zero position and the printer is automatically set in the other condition, in which it prints signs with a character associated with reception.

The automatic setting can also be used in combination with other methods for changing the characters of the printed signs.

What is claimed is:

1. A mosaic printer which comprises a printing head mounted for movement along a first rectilinear line proximate to an associated printing sheet to produce a plurality of signs arrayed in a second rectilinear line parallel to said first rectilinear line, said printing head being provided with a number of printing wires, each of said wires including means which upon preselected axial travel produce a printing mark on the associated printing sheet, a plurality of said marks producing said signs said wires extending from a first part of said printing head in the vicinity of the associated printing sheet substantially along a third rectilinear line, said third rectilinear line and said second rectilinear line having an included angle, at least said first part of said printing head being rotatable about an axis which is substantially perpendicular to the associated printing sheet, and a setting mechanism to position said first part of said printing head to at least two discrete angular positions, in which said third rectilinear line is disposed at different included angles with respect to said first and second rectilinear lines for producing signs with different heights and inclination by said setting mechanism before printing any individual sign and without change of said elements, said included angles being less than 100 degrees and said included angle not varying during the printing of any one sign.

2. A printer as claimed in claim 1 wherein the whole printing head is rotatably journalled and said setting mechanism is electromagnetic, said head being moved to different angular position responsive to said electromagnetic setting mechanism.

3. A printer as claimed in claim 1 wherein during one setting position said third rectilinear line formed by the printing elements is perpendicular to the motion direction for producing signs without inclination, while in at least one other setting position said third rectilinear line of printing elements is disposed in oblique relationship to the motion direction for producing inclined signs.

4. A printer as claimed in claim 3, wherein the apparatus includes means for generating a signal connected to the transmitting and receiving circuits of an associated telex apparatus, said signal varying with reception and transmission telex modes, said printer switching between a first condition during telex transmission, in which it prints signs having a certain character, and a second condition during telex reception, in which it prints signs having a different character responsive to said signal.

* * * * *